US008757928B1

(12) United States Patent
Smith

(10) Patent No.: US 8,757,928 B1
(45) Date of Patent: Jun. 24, 2014

(54) METHOD AND APPARATUS FOR AN ANCHORAGE DEVICE

(75) Inventor: Sidney Smith, Savannah, GA (US)

(73) Assignee: Complete Consent, LLC, Savannah, GA (US)

( * ) Notice: Subject to any disclaimer, the term of this patent is extended or adjusted under 35 U.S.C. 154(b) by 422 days.

(21) Appl. No.: 12/082,349

(22) Filed: Apr. 10, 2008

(51) Int. Cl.
*E02D 5/80* (2006.01)
*B09C 1/08* (2006.01)

(52) U.S. Cl.
USPC ..... 405/128.7; 405/259.1; 52/161

(58) Field of Classification Search
USPC ..... 405/128.7, 258.1, 259.1, 263, 302.4; 52/155, 161
See application file for complete search history.

(56) References Cited

U.S. PATENT DOCUMENTS

| | | | | |
|---|---|---|---|---|
| 2,776,634 | A * | 1/1957 | Morton | 111/92 |
| 2,881,591 | A | 4/1959 | Reeve | |
| 3,540,589 | A | 11/1970 | Boris | |
| 3,759,495 | A | 9/1973 | Boler | |
| 3,763,655 | A | 10/1973 | Galuska | |
| 4,409,107 | A | 10/1983 | Busch | |
| 4,637,757 | A | 1/1987 | Aagaard | |
| 4,659,259 | A * | 4/1987 | Reed et al. | 405/263 |
| 4,846,655 | A | 7/1989 | Gulley | |
| 5,396,743 | A | 3/1995 | Bellette | |
| 5,494,378 | A | 2/1996 | Hanson | |
| 5,503,501 | A * | 4/1996 | Kunito | 405/241 |
| 6,349,514 | B1 | 2/2002 | Adams | |
| 6,514,013 | B2 | 2/2003 | Li et al. | |
| 6,681,518 | B2 * | 1/2004 | Aesch et al. | 43/132.1 |
| 6,716,421 | B2 * | 4/2004 | Brode et al. | 424/84 |
| 7,025,016 | B1 | 4/2006 | Landes | |
| 7,090,117 | B2 | 8/2006 | Lackey | |
| 2003/0221378 | A1 * | 12/2003 | Krieger | 52/155 |
| 2006/0011147 | A1 * | 1/2006 | Krieger | 119/788 |

* cited by examiner

*Primary Examiner* — Benjamin Fiorello
(74) *Attorney, Agent, or Firm* — Nixon & Vanderhye P.C.

(57) ABSTRACT

A pole with an eyelet disposed at one end and the first and second group of furled cup shaped furled containers are connected along the longitudinal length of the pole. The pole with the containers is inserted into a substance. The substance may, if desired, be sand, mud or mud-like soil. If desired, the insertion process may be accomplished by forcing the pole into the substance by applying downward force on the eyelet or twisting the pole in a clockwise direction into the substance. Once the pole is inserted into the substance the pole may, if desired, be twisted in the counterclockwise direction to unfurl the cup shaped containers. To extract the pole, the pole is twisted in the clockwise direction closing the cup shaped containers and pulling the pole in the vertical direction.

10 Claims, 3 Drawing Sheets

METHOD AND APPARATUS FOR AN ANCHORAGE DEVICE

BACKGROUND

There exists a requirement for an anchorage device that can be set into soil, sandy soil, mud or mud-like soil. An ordinary soil stake must penetrate relatively easily but on the other hand provide secure anchorage and offer significant resistance to forces urging the stake from the soil. While this type of stake works reasonably well in dry soil it falters when in wet soil or sand where the stake is urged in the vertical direction and there is little or no resistance to the removal of the stake from the wet soil or sand.

One attempt to resolve the requirement for anchorage is a hold down device that has a plurality of adjacent conical segments disposed along the length of a stake shaft wherein each conical segment has an upward facing shoulder to resist removal of the stake from the soil. However, the surface area provided by these upward facing shoulders is relatively small. Additionally, the series of adjacent conical sections requires a relatively large amount of material to fabricate.

It is desirable to have an anchorage device that is easily insertable into sand, mud or mud-like soil. When fully deployed the device would resist vertical forces applied thereto. If desired, the deactivated device should be easily withdrawn from the soil.

SUMMARY

The present invention comprises a pole with an eyelet disposed at one end or a cylindrical object with the first and second groups of cup shaped furled containers that are connected along the longitudinal length of the pole. The pole with the containers is inserted into a substance. The substance may, if desired, be sand, mud, mud-like soil or mud-like soil of any chemical composition. If desired the insertion process may be accomplished by forcing the pole into the substance by applying downward force on the eyelet or twisting the pole in a clockwise direction into the substance. Once the pole is inserted into the substance the pole may, if desired, be twisted in the counterclockwise direction to unfurl the cup shaped containers. This process is twofold. First, the open cup shaped containers' material may, if desired, chemically react with the substance and second, extraction of the pole in the vertical direction is inhibited due to the open cup shaped containers. To extract the pole, the pole is twisted in the clockwise direction closing the cup shaped containers and pulling the pole in the vertical direction.

When taken in conjunction with the accompanying drawings and the appended claims, other features and advantages of the present invention become apparent upon reading the following detailed description of the embodiment of the invention.

BRIEF DESCRIPTION OF THE DRAWING

The invention is illustrated in the drawings in which like reference characters designate the same or similar parts throughout the figures of which.

DETAILED DESCRIPTION

Figure 1:
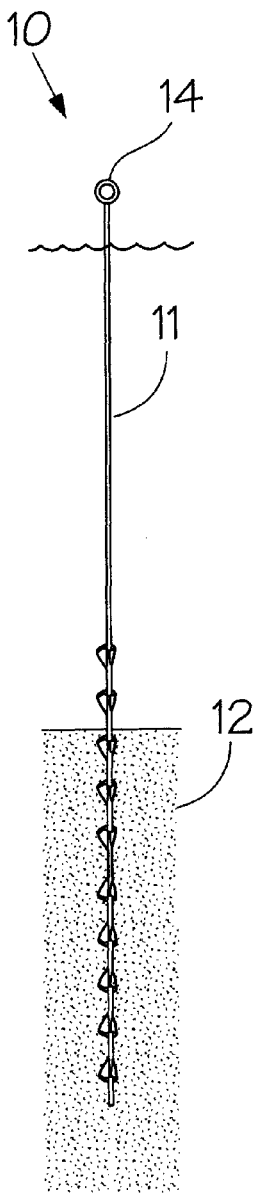
FIG. 1 illustrates a top-level schematic diagram view of the present invention inserted into a substance.
Figure 2:
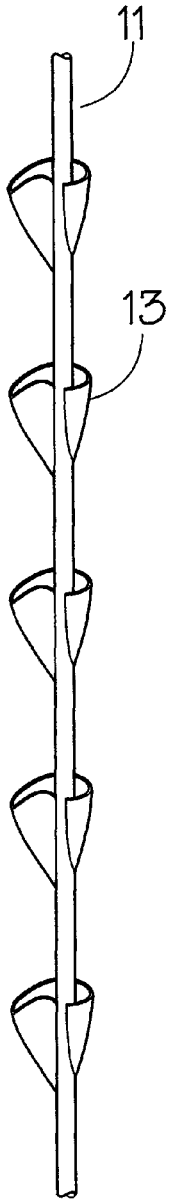
FIG. 2 illustrates a top-level schematic diagram view of an elongated pole with a plurality of cup shaped containers disposed thereon.

Before describing in detail the particular improved anchorage device to chemically treat a substance in accordance with the present invention, it should be observed that the invention resides primarily in the novel structural combination of conventional chemical treatment components and in the particular detailed configuration thereof. Accordingly, the anchorage device arrangement has, for the most part, been illustrated in the drawing by readily understandable schematic diagrams. The drawing shows only those specific details that are pertinent to the present invention in order not to obscure the disclosure with structural details which will be readily apparent to those skilled in the art having the benefit of the description herein.

Figure 3:
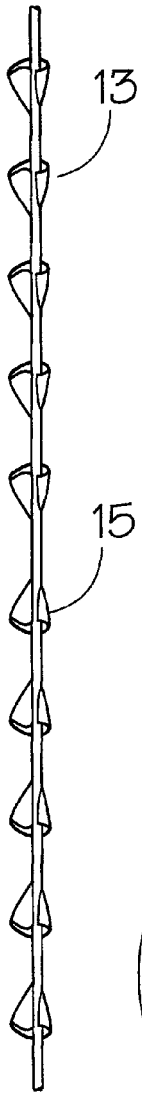
FIG. 3 illustrates a top-level schematic diagram view of an elongated pole with two opposing groups of cup shaped containers.
Figure 4:
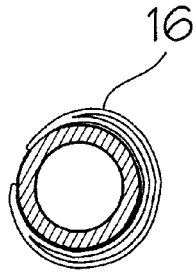
FIG. 4 illustrates a top-level schematic diagram top view of furled cup shaped containers.
Figure 5:
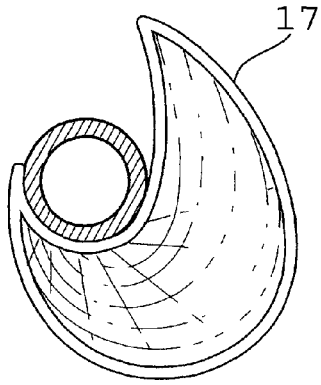
FIG. 5 illustrates a top-level schematic diagram top view of unfurled cup shaped containers.

The present invention 10, FIG. 1 is an anchorage device to chemically treat a substance 12. he substance 12 may, if desired, be seabed material and the like or seawater. The material may, if desired, be a sand, mud-like consistency or mud-like soil with any chemical composition. The anchorage device is an elongated pole 11 with an eyelet 14 disposed at one end. The eyelet 14 is sized to receive one end of a connecting chain or rope to stabilize a second body or mass. The elongated pole 11, FIG. 3 has a first group of cup shaped containers 13 adjacently spaced from the eyelet 14. The first group of cup shaped containers 13 is connected along the longitudinal length of the pole 11. A second group of cup shaped containers 15 is oppositely spaced from the first group of cup shaped containers 13 and connected along the longitudinal length of pole 11. The cup shaped containers of group one and group two are furled 16, FIG. 4 along the longitudinal length of the pole 11. The cup shaped containers of group one and group two are unfurled 17, FIG. 5 along the longitudinal length of the pole 11. The pole 11 may, if desired, be made from a hard-like material. Examples of hard-like materials are steel, aluminum and water resistant wood. The cup shaped containers 13 and 15 are manufactured from a flexible material. The cup shaped containers 13 and 15 may, if desired, be filled with chemicals to treat the substance 12. These chemicals may, if desired, be cake-like in composition. The cake-like chemicals dissolve when they come into contact with water or the chemicals may be a sponge-like material that expands in size many fold when it comes into contact with water. The sponge-like material due to its expandability facilitates the opening of cup shaped containers 13 and 15.

In operation: The present invention 10, FIG. 1 comprising the pole 11 with eyelet 14 and the first and second cup shaped furled containers is inserted into the substance 12. The insertion process may, if desired, be by forcing the pole 11 into the substance 12 by applying downward force on the eyelet 14 or twisting the pole in a clockwise direction into the substance 12. Once the pole 11 is inserted into the substance 12 the pole may, if desired, be twisted in the counterclockwise direction to unfurl the cup shaped containers 13 and 15. This process is twofold. First, the open cup shaped containers' 13 and 15 material may, if desired, chemically react with the substance 12 and second, the extraction of the pole 11 in the vertical direction is inhibited due to the open cup shaped containers. To extract the pole 11, the pole is twisted in the clockwise direction and pulled in the vertical direction.

Figure 6A:
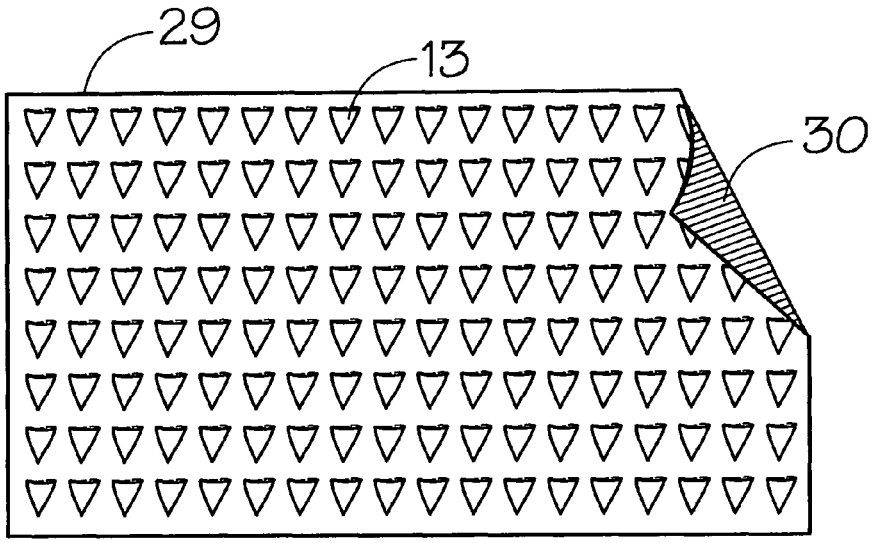
FIG. 6*a* illustrates a top-level schematic diagram of the second embodiment of the present invention.
Figure 6B:
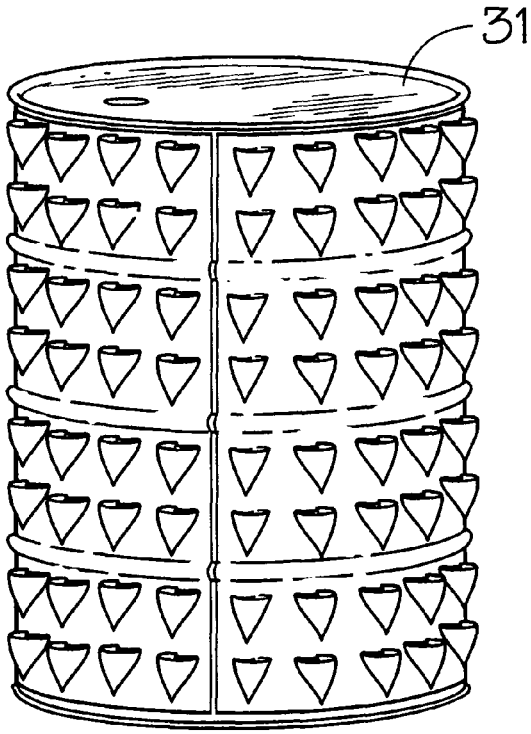
FIG. 6*b* illustrates a top-level schematic diagram of an example of the second embodiment of the present invention.

The second embodiment of the present invention 10, FIG. 6*a* is an adhesive backed sheet 29 having disposed thereon a plurality of cup shaped containers 13. The cup shaped containers 13 are in the open position ready to receive water purification chemicals. The chemicals are a cake-like substance as discussed above. The cake-like substance is hardened in the cup shaped containers 13. When the cup shaped containers 13 containing the hardened chemicals come into contact with water the cake-like substance dissolves releasing the chemicals to the surrounding water. The adhesive backed sheet 29 has an adhesive 30 disposed thereon that is water resistant. An example of the adhesive backed sheet 29 is a drum 31 with the adhesive backed sheet disposed thereon. After the adhesive backed sheets 29 are disposed on the drum 31 the drum is submerged in water and the cake-like substance dissolves releasing the chemicals to the surrounding water.

Figure 7A:
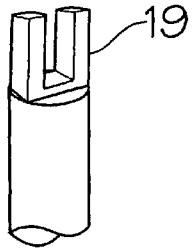
FIG. 7*a* illustrates a top-level schematic diagram of the third embodiment of the present invention delineating a pole with a flat top having a U-shaped member attached thereto.
Figure 7B:
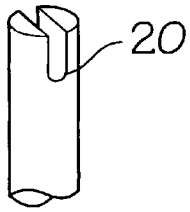
FIG. 7*b* illustrates a top-level schematic diagram of the third embodiment of the present invention delineating a pole with a flat top having a notch inserted therein.
Figure 7C:
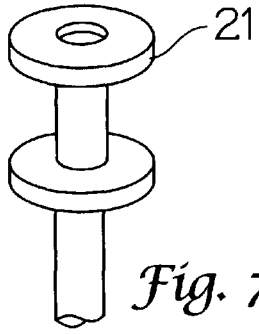
FIG. 7*c* illustrates a top-level schematic diagram of the third embodiment of the present invention delineating a pole with a flat top having a spool connected thereto.
Figure 7D:
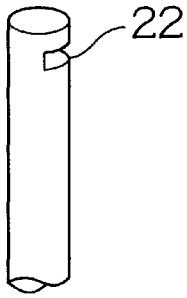
FIG. 7*d* illustrates a top-level schematic diagram of the third embodiment of the present invention delineating a pole with a flat top having a side notch disposed therein.
Figure 7E:
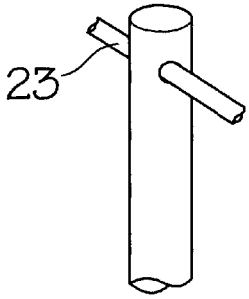
FIG. 7*e* illustrates a top-level schematic diagram of the third embodiment of the present invention delineating a pole with a flat top having a cross member attached thereto.
Figure 7F:
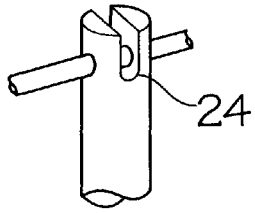
FIG. 7*f* illustrates a top-level schematic diagram of the third embodiment of the present invention delineating a pole with a flat top having a notch and a cross member inserted therein.
Figure 7G:
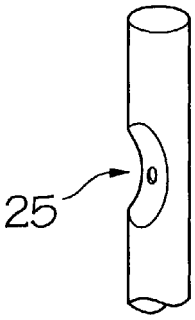
FIG. 7*g* illustrates a top-level schematic diagram of the third embodiment of the present invention delineating a pole with a flat top having a cutout along the longitudinal length of the pole.
Figure 7H:
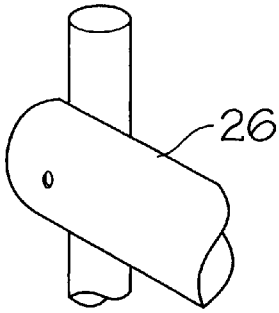
FIG. 7*h* illustrates a top-level schematic diagram of the third embodiment of the present invention delineating a pole inserted into the cutout of FIG. 7*g*.
Figure 7I:
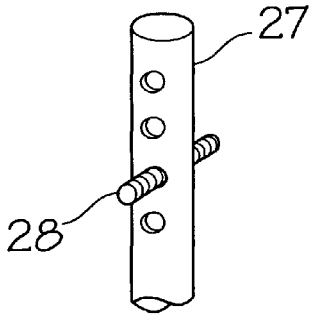
FIG. 7*i* illustrates a top-level schematic diagram of the third embodiment of the present invention delineating a plurality of holes disposed along the longitudinal length of the pole, the holes sized to receive a screw like cross member.

The third embodiment of the present invention 10, FIGS. 7*a* to 7*i* is a pole, similar to the pole discussed in the first embodiment, with a plurality of different connection tops. The FIG. 7*a* illustrates a U-shaped member 19 connected to the top of the pole. The U-shaped member 19 is sized to receive and secure thereto a chain or rope. The FIG. 7*b* illustrates a notch 20 inserted in the top end of the pole. The notch 20 is sized to receive and secure thereto a chain or rope. A spool connector 21, FIG. 7*c* is affixed to the top end of the pole. The spool connector 21 is sized to receive a rope and have the rope secured thereto. A notch 22, FIG. 7*d* is disposed adjacent to and along the longitudinal length of the pole. The notch 22 is sized to receive a rope and have the rope secured thereto. A cross member 23, FIG. 7*e* is connected to a pole adjacent to the top end. This cross member 23 is of sufficient construction to secure a rope thereto. The FIG. 7*f* illustrates a combination of a notch and cross member 24. The notch and cross member 24 facilitates the securing of a rope or chain. The FIGS. 7*g* and 7*h* illustrate a cutout 25 along the longitudinal length of the pole. Member 26, FIG. 7*h* is an elongated round pole that has one end inserted into the cutout 25. An elongated pole 27, FIG. 7*i* has a plurality of holes disposed therein. The holes are sized to receive a screw-like member that is inserted into a selected hole to facilitate the securing of a rope or chain.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claim, means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. An anchorage device in cooperation with a selected substance, comprising:

a) an elongated rod; and b) a plurality of cup-shaped containers longitudinally spaced along said elongated rod, said cup-shaped containers being secured around said elongated rod and displaceable between a furled position and an unfurled position, wherein the cup-shaped containers are wrapped around the elongated rod.

2. An anchorage device in cooperation with a selected substance, comprising:

a) an elongated rod;

b) a plurality of cup-shaped containers longitudinally spaced along said elongated rod, said cup-shaped containers being secured around said elongated rod and displaceable between a furled position and an unfurled position; and c) a chemical placed inside said plurality of cup-shaped containers.

3. An anchorage device as recited in claim 2, wherein the chemical is structured to treat the selected substance.

4. An anchorage device as recited in claim 2, wherein the chemical is a sponge-like material that expands in size when it comes into contact with water.

5. An anchorage device as recited in claim 2, wherein the chemical is structured to displace the cup-shaped containers from the furled position to the unfurled position when the chemical comes into contact with water.

6. A method for an anchoring device in cooperation with a selected substance, comprising the steps of:

a) providing an elongated pole having a plurality of cup-shaped containers connected along its longitudinal length, the cup-shaped containers initially being secured around the elongated pole in a furled position and being displaceable between the furled position and an unfurled position;

b) inserting the elongated pole into the selected substance; and c) displacing the cup-shaped containers from the furled position to the unfurled position by rotating the elongated pole in a direction opposite to a furling direction of the cup-shaped containers.

7. An anchorage device in cooperation with a selected substance, comprising:

a) an elongated rod; and b) a plurality of cup-shaped containers longitudinally spaced along said elongated rod, said cup-shaped containers being secured around said elongated rod and displaceable between a furled position and an unfurled position, the plurality of cup-shaped containers including a first group of said cup-shaped containers facing a direction in which said elongated rod is inserted into the selected substance and a second group of said cup-shaped containers facing an opposite direction.

8. A method for an anchoring device in cooperation with a selected substance, comprising the steps of:

a) providing an elongated pole having a plurality of cup-shaped containers connected along its longitudinal length, the cup-shaped containers initially being secured around the elongated pole in a furled position and being displaceable between the furled position and an unfurled position;

b) inserting the elongated pole into the selected substance;

c) displacing the cup-shaped containers from the furled position to the unfurled position; and d) disposing a chemical in the cup-shaped containers.

9. A method as recited in claim 8, wherein step c) is practiced by expansion of the chemical after coming into contact with water.

10. A method as recited in claim 8, further comprising, after step b), treating the selected substance with the chemical.

* * * * *